US006923721B2

(12) United States Patent
Luciano et al.

(10) Patent No.: US 6,923,721 B2
(45) Date of Patent: Aug. 2, 2005

(54) APPARATUS AND METHOD FOR MAINTAINING GAME STATE

(75) Inventors: Robert A. Luciano, Reno, NV (US); Robert W. Crowder, Jr., Las Vegas, NV (US)

(73) Assignee: Sierra Design Group, Reno, NV (US)

( * ) Notice: Subject to any disclaimer, the term of this patent is extended or adjusted under 35 U.S.C. 154(b) by 0 days.

(21) Appl. No.: 09/742,679

(22) Filed: Dec. 20, 2000

(65) Prior Publication Data

US 2002/0077173 A1 Jun. 20, 2002

(51) Int. Cl.[7] ..... A63F 5/00

(52) U.S. Cl. ..... 463/24; 463/16; 463/18; 463/20; 463/21; 463/25

(58) Field of Search ..... 463/16, 17, 23, 463/25, 26, 42; 705/16

(56) References Cited

U.S. PATENT DOCUMENTS 4,342,454 A * 8/1982 Baer et al. ..... 345/672
4,575,622 A * 3/1986 Pellegrini ..... 235/382
4,752,068 A * 6/1988 Endo ..... 463/15
4,858,930 A * 8/1989 Sato ..... 273/148 B
5,014,982 A * 5/1991 Okada et al. ..... 463/24
5,179,517 A * 1/1993 Sarbin et al. ..... 463/25
5,265,874 A * 11/1993 Dickinson et al. ..... 463/25
5,983,196 A * 11/1999 Wendkos ..... 705/14
6,007,426 A * 12/1999 Kelly et al. ..... 463/16
6,009,412 A * 12/1999 Storey ..... 705/14
6,015,344 A * 1/2000 Kelly et al. ..... 463/16
6,048,269 A * 4/2000 Burns et al. ..... 463/25
6,061,660 A * 5/2000 Eggleston et al. ..... 705/14
6,113,493 A * 9/2000 Walker et al. ..... 463/20
6,165,071 A * 12/2000 Weiss ..... 463/24
6,178,408 B1 * 1/2001 Copple et al. ..... 705/14
6,244,958 B1 * 6/2001 Acres ..... 463/16
6,251,014 B1 * 6/2001 Stockdale et al. ..... 463/16
6,302,793 B1 * 10/2001 Fertitta, III et al. ..... 463/25
6,311,976 B1 * 11/2001 Yoseloff et al. ..... 273/138.2
6,312,334 B1 * 11/2001 Yoseloff ..... 273/138.1
6,340,331 B1 * 1/2002 Saunders et al. ..... 235/380
6,394,900 B1 * 5/2002 McGlone et al. ..... 273/142 R
6,398,650 B1 * 6/2002 Horigami et al. ..... 463/1

* cited by examiner

*Primary Examiner*—Teresa Walberg
*Assistant Examiner*—Yveste G. Cherubin
(74) *Attorney, Agent, or Firm*—Russ F. Marsden

(57) ABSTRACT

A system and method for maintaining player's game state (award credits or game pieces) in a gaming environment is disclosed. In particular, the player may restore the game state from previously played games either from the same game device or from another game device. The invention also provides for award redemption of the award credits (or game pieces) earned by a player during game play.

10 Claims, 11 Drawing Sheets

APPARATUS AND METHOD FOR MAINTAINING GAME STATE

BACKGROUND OF THE INVENTION

1. Field of the Invention

This invention pertains generally to gaming systems. More particularly, the invention is a apparatus and method configured to maintain a player's game state.

2. The Prior Art

Gaming devices of various types have been in use for many years. The most common type is the conventional slot. A player operates a slot machine by providing coin or paper monies that are received as game credits towards playing a game on the slot machine. Some machines allow a user to provide game credits in the form of a voucher, a printed coupon or a data card (e.g. magnetic strip or smart card). Once the sufficient amount of game credits has been provided to constitute a wager, the player then initiates the game, normally by pulling a handle or activating a button. If a winning event occurs pursuant to the game, the slot machine issues a winning amount according to the player's wager and to a predetermined pay scheme. The game results are generally based on randomly generated events. The winning amount issued to the user is provided by a corresponding amount of game credits, which the player may redeem (cash-out) or use for further play on the slot machine. Similar game play and award schemes are provided according to other gaming devices such as video poker machines and keno machines.

Bonus and progressive awards have been introduced as improvements to conventional gaming devices to entice increased game play and income for casinos. For example, a common bonus scheme is to award a player a chance to multiply his award winnings pursuant to a secondary or bonus stage of the game. Most bonus awards are simply an increased multiple of the primary winnings and are issued as game credits suitable for redemption or further play of the gaming device. In certain cases where the bonus award is large, manual payout by a casino attendant may be required. In some cases, a non-monetary prize (e.g., a car or motorcycle) is made the subject of the bonus award. Like the monetary progressive awards, these non-monetary prizes are normally tendered manually by a casino attendant.

Progressive awards, like bonus awards, also normally comprise simple monetary credits, but typically comprise a large jackpot amount. Progressive schemes employ a plurality of gaming machines that the players of each compete for the progressive award, wherein a portion of the wager is contributed to the progressive award. Upon the occurrence of a specific game result, the progressive award is issued to the player. Since the progressive award is normally large, it is normally paid manually by a casino attendant or cashier.

Another prior art gaming implementation is known as "investment bonus". An example of this type of game is the 1937 Mills "Bonus Bell" game which provides a primary slot reel game, and a secondary investment bonus game (or "come-on" feature). During play the word "BONUS" could be spelled out by hitting the correct letters in sequence on the first reel for an eighteen (18) coin award. This type of game is generally referred to as an "investment bonus" game, because the player invests in continued play of the same machine to achieve the requirements for the bonus award (e.g., forming the word "BONUS"). If the player were to terminate play of the investment game prior to completing the requirements for the bonus award (e.g., the player only completes "BON", the player normally forfeits the player's prior investments ("BON") and must later fulfill the requirements anew. Furthermore, a subsequent player may "take over" a previous player's investment by commencing play of the investment bonus game after the previous player vacates the machine.

Current gaming devices and methods, while suitable for normal award credit payout and one-time non-monetary prize payout, have some particular disadvantages. First, current gaming schemes are not well suited for awarding prizes having a hierarchical arrangement which require a player to collect two or more "winning events" towards the redemption of an award. This is especially true where the winning events may be derived from two or more gaming machines. For example, in conventional "bonus", secondary, or investment bonus games, the player may accumulate points towards redemption of a bonus prize. An example of such points may be spaces on a game board such as tic-tac-toe or Monopoly™ or in the case of the Mills game, a collection of letters to form the word "BONUS". Once the player has accumulated the sufficient number of (e.g., collection of or arrangement of) game points, the player may be awarded a bonus prize. However, current systems do not allow a player to collect the player's game points on one machine for usage on a secondary machine for further collection of points toward prize redemption. Nor do current systems provide the collection of points on one machine for redemption of awards on another machine or a central (or separate) prize station. Current systems also fail to provide for collection of points on one machine for later aggregation with the same machine during subsequent play.

Furthermore, current systems do not provide a hierarchical scheme of non-monetary prizes. As noted above, current bonus or progressive prizes present a single jackpot, perhaps at various prize levels. However, current systems fail to provide for accumulation of lower prize awards for subsequent opportunities at achieving higher level award prizes based on the accumulation of lower prize awards. A system which would offer game play and accumulation of points towards redemption of prizes either on a second gaming machine or a central or separate prize station would entice continued game play and therefore additional revenue for the casino.

According to some jurisdictions, gaming is restricted to lottery-based play, where a game results is selected from a fixed pool of outcomes, rather than from a randomly generated event. These systems also provide for similar bonus or progressive structures as described above utilizing fixed-pool schemes. The needs outlined above for an award and redemption system having movable game points or credits are also needed in lottery-based gaming environments to encourage increased game play and thereby increase revenue.

BRIEF DESCRIPTION OF THE INVENTION

To overcome these and other shortcomings of the prior art, disclosed herein is a gaming apparatus and method suitable for use with games of chance including live table games, as well as lottery-based games, which allows a user to collect and redeem "award credits" on one or more machines for redemption of prizes at another machine or a centralized or separate award station. The present invention is likely suitable for use with games involving skill, such as arcade video games and home electronic and computer video games.

The system of the present invention generally comprises one or more gaming devices (e.g., slot machine, video lottery terminal, keno machine, live table game, bingo game) and a prize station having one or more prizes. During play of the gaming device, a particular game result may provide a winning event at which the gaming device issues an "award credit" to the player of the gaming device. The winning event may be based on the primary game (e.g., indicia combination on a primary slot game) or based on a secondary game (e.g., indicia indicated by a secondary wheel game) as well as other non-primary games. Under this arrangement, the game play for the "award credits" can be made independent of the underlying primary or secondary game, if so desired.

Unlike traditional loyalty programs which award "prizes" based on the number of plays (e.g., free lunch buffer after 100 slot plays) or the amount of credits won (e.g., free hotel stay after player wins 100 game credits), the present invention provides "award credits" based on a game event (e.g., game results on the primary or secondary other non-primary game).

The player may accumulate additional "award credits" during continued play of the gaming device. The award credits, unlike game credits, are generally not redeemable for further play on the game device, but rather may be redeemed for the prizes (e.g. goods, services, or monetary awards) at the prize station once the appropriate accumulation has been established.

The system is further configured to allow the player to collect the award credits from one gaming device for usage on other gaming devices or for redemption of prizes at the prize station. In this way, the award credits are generally associated with a particular player via a prize bearing instrument (PBI) which is described herein. The award credits may also be accumulated without a PBI, where the award credits are maintained on a memory (such as that used with conventional credit meters) either locally on the gaming device or via a server in communication with the gaming device.

According to one embodiment to of the invention, the PBI is a voucher (printed ticket) printed by the gaming device via a printer. The voucher may then be presented to a voucher reader on the same or a second gaming device that ascertains the number of credits associated with the player. The player may accumulate further award credits during continued play of the same or second gaming device, the additional award credits accumulated with previous award credits. The award credits may be collected and transferred repeatedly. The system contemplates usage of other PBI media such as magnetic or smart cards. The system also contemplates manual entry of voucher information by a player to the gaming device, where the gaming device is not equipped with a voucher reader, for example. The voucher information entered by the player may then be used to access a central server which identifies the player's game state and award credit information.

As is known in the art, the award credits may be embedded as machine or human readable data in or on the PBI. In this way, the gaming devices need not be coupled for communication with each other or with the prize station to determine the award credits associated with the players; the award credits may be determined directly from the PBI. As is also known in the art, the data on the PBI may be secured using encryption technology.

According to one of the preferred embodiments of the invention, the gaming devices and the prize station of the present system are operatively coupled for communication with each other, normally via a network or data connection. In this way, transactions and award credits may be verified by a "back-end" validation device. In this environment, award credits may be maintained on a database associated with validation device rather than on the PBI. The PBI may simply contain identifying information to associate a player with the player's award credits, which is contained on the database, thereby providing increased security of the award credits. Another benefit of a networked environment is that the prizes may be remotely monitored by a central inventory device via tracking (e.g., RFID) tags associated with the prizes. Copending application by the applicant entitled "Apparatus and Method for Dispensing of Awards" having attorney docket number 732.179 discloses a method of tracking prizes via an inventory device, the disclosure of which is incorporated herein by reference.

According to another aspect of the invention, promotional award credits may be issued to promote the player to play the game devices of the invention. The promotional award credits may be issued to the player according to non-gaming activities, such as via a mailing promotion and a PBI. The promotional award credits may be combined with other award credits issued by gaming devices for collection and redemption for prizes.

Once the player has accumulated the requisite (e.g., collection and/or quantity of) award credits for prize redemption, the player may redeem the award credits via the prize station. In general, the player presents the PBI to the prize station that determines the award credits associated with the player and determines the prizes to which the player is entitled. According to one embodiment of the invention, prizes are assigned a particular number of award credits for redemption. According to another embodiment, prizes are assigned according to a collection (or types) of award credits. The prize station offers a prize selection to the player according to the player's award credits.

In general, the prizes are maintained in a protectable area visible to the users. For example, the prizes may be maintained in one or more vaults, each having a door equipped with a window, each door secured by a latch. Upon selection of a prize, the latch is released to allow the user to retrieve the selected prize. The present invention contemplates various dispensing means for awarding the prize to the player including the use of additional security and verification. For example, the prize station may first verify that the prize to be awarded is present in the requested vault by first checking the RFID. The prize station may also provide verification of the player's award credits prior to dispensing the award. The prize station may also require a casino attendant to provide a security key (e.g., a card key and/or physical key) prior to dispensing the award.

According to another embodiment of the invention, the prize station comprises a computer device where the prizes are displayed via a monitor device. The user may select a displayed prize, which may be tendered to the player via a kiosk prize station, via an attendant (manually) or via a courier service. In this way, the prize station may be provided via a web-based system, suitable for access via any conventional data processing device (computer) and suitable for connection to the web-based system.

Various arrangements of the gaming device and the prize station are further contemplated by the present invention. For example, the gaming device and the prize station may be integrated into a single unit or the prize station may be integrated into a second gaming device. The prize station may be alternatively managed by a casino attendant using a prize booth, where the attendant verifies the player's award credits and manually tenders the selected prize.

According to another embodiment of the present invention, a prize award may be dependent upon the player earning an "award credit" each of a predetermined number of game types or game machines. For example, the player may need to win "car award credit" from each often (10) machines (e.g. slot machine, poker machine, keno machine, etc.) to win a car prize. This arrangement encourages game play on each of the machines where the player may win the requisite "award credits". In another example, the player may be required to win "award credits" from different "groups" or banks of gaming machines, perhaps located in different casino sites.

The invention further relates to machine readable media on which are stored embodiments of the present invention. It is contemplated that any media suitable for retrieving instructions is within the scope of the present invention. By way of example, such media may take the form of magnetic, optical, or semiconductor media. The invention also relates to data structures that contain embodiments of the present invention, and to the transmission of data structures containing embodiments of the present invention. Further objects and advantages of the invention will be brought out in the following portions of the specification, wherein the detailed description is for the purpose of fully disclosing the preferred embodiment of the invention without placing limitations thereon.

BRIEF DESCRIPTION OF THE DRAWINGS

The present invention will be more fully understood by reference to the following drawings, which are for illustrative purposes only.

DETAILED DESCRIPTION OF THE PREFERRED EMBODIMENTS

Persons of ordinary skill in the art will realize that the following description of the present invention is illustrative only and not in any way limiting. Other embodiments of the invention will readily suggest themselves to such skilled persons having the benefit of this disclosure.

Referring more specifically to the drawings, for illustrative purposes the present invention is embodied in the apparatus shown in FIG. 1 through FIG. 9. It will be appreciated that the apparatus may vary as to configuration and as to details of the parts, and that the method may vary as to details and the order of the acts, without departing from the basic concepts as disclosed herein. The invention is disclosed generally in terms of a system maintaining player's award credits in a gaming environment, although numerous other uses for the invention will suggest themselves to persons of ordinary skill in the art, including usage in arcade and home entertainment environments, for example.

Figure 1:
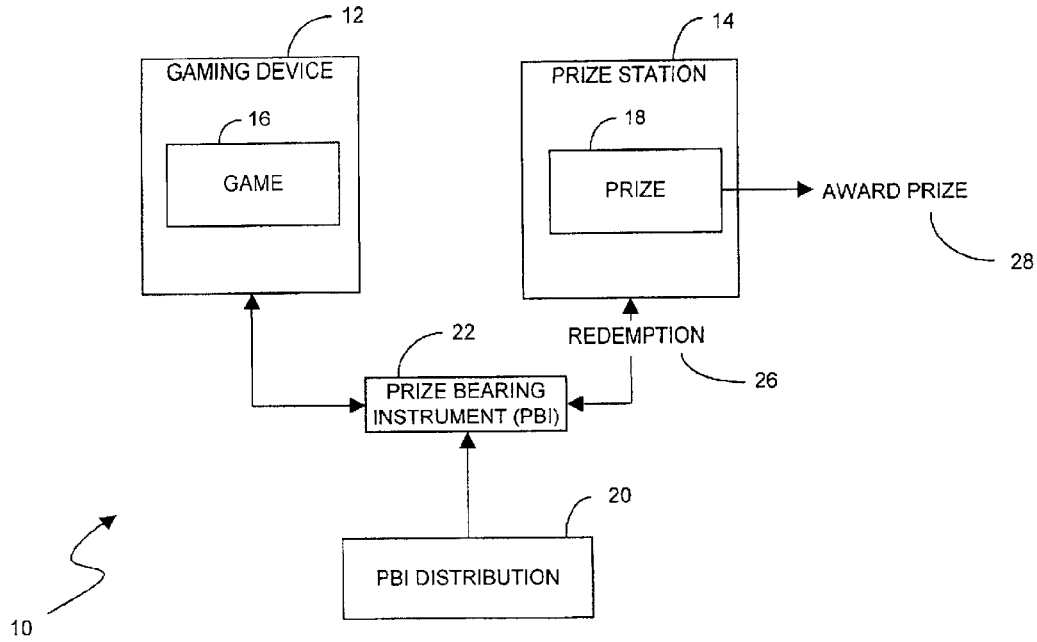
FIG. 1 is a functional block diagram of an example system for maintaining game states in accordance with the present invention.

Referring first to FIG. 1, a block diagram of an example system 10 for maintaining a player's state is generally shown. System 10 includes a gaming device 12 and a prize station 14. Gaming device 12 comprises a conventional game of chance, such as a slot machine, video poker machine, video lottery device, keno machine, bingo machine. The gaming device 12 may alternatively comprise a live table game of chance, such as a blackjack table or roulette table, where the functions described herein carried out by the gaming device are carried out by a table attendant.

With respect to gaming device 12, provided therein is a game 16 configured for play by a player. Accordingly, gaming device 12 includes typical hardware and software components (not shown), such as a processor, memory, and input/output devices such as a video output and control inputs, and game software, for executing game 16. According to play of the game 16, one or more game results may provide the player with an "award credit". As noted above, the game results may be provided by a game of chance involving random events or may be provided from a predetermined outcome selected from a fixed pool (e.g., a lottery).

Award credits, unlike game credits which are used for playing the game 14, are suitable for redemption of prizes or awards on the prize station 14. For example, the award credits may comprise game pieces which may be collected by the player for redemption at the prize station 14. In this example, the game pieces may be part of a game board or puzzle and when the player has collected a particular subset (i.e., collection or accumulation) of game pieces, the player may be entitled to an award or prize from the prize station 14.

Figure 2A:
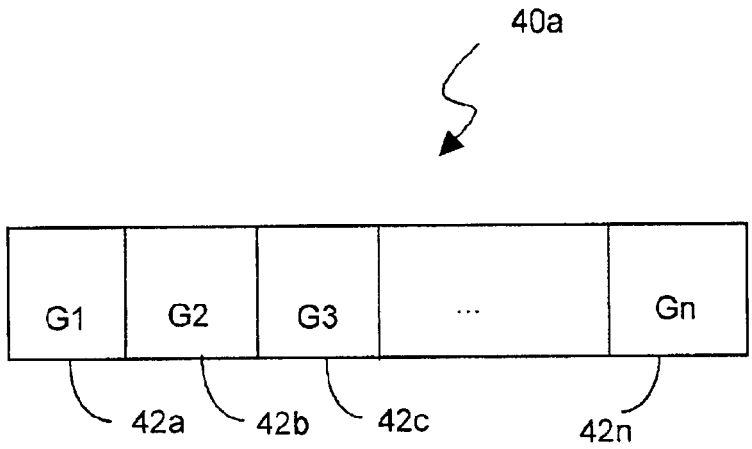
FIG. 2 is a functional block diagram of an example game board suitable for use with the present invention.

FIG. 2*a* illustrates a sample game board 40*a* having spaces for game pieces 42*a* through 42*n*. The game pieces 42*a* through 42*n* may be represented by indicia or representation to a particular theme, such as a popular board game, television show, movie, etc. Certain games rules may require accumulation of all or part of the game pieces 4*a* through 42*n* for prize awards.

Figure 2B:
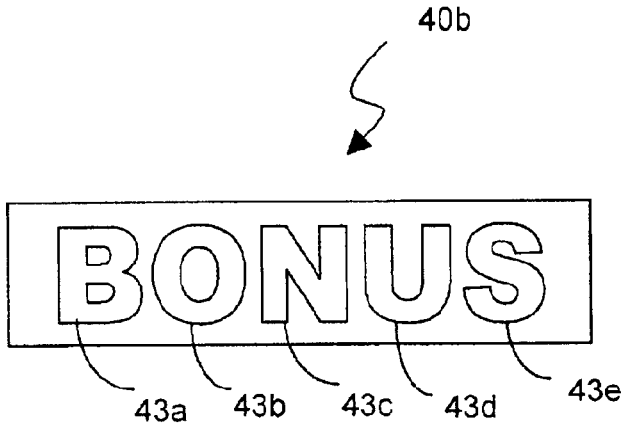

FIG. 2*b* illustrations a second sample game board 40*b* having letter space holders to accommodate letters 43*a* through 43*e* corresponding to the word "BONUS". This game, similar to the Mills game described above, allows a player to collect letters (game pieces) from the word "BONUS" during game play of the primary game, normally a slot game. Once the player has collected all the letters, the player may redeem a "Bonus" prize from the prize station.

Other game board formats and rules are also suitable for use with the present invention.

According to one aspect of the invention, the gaming device 12 is configured to maintain a record of the accumulated award credits (game pieces) associated with the player, including award credits earned during play of the game 16. The player may maintain the player's state of award credits earnings (e.g., game state) even when the player has terminated play of the gaming device 12. In the present embodiment, the player's game state is maintained via a prize bearing instrument (PBI) 22. The PBI 22 may comprise any media suitable for associating a player's award credits with the player. Example media include a printed ticket (voucher), a magnetic or smart card, or other information storage medium. As an interface to the PBI 22, the gaming device 12 provides a PBI reader/writer device (not shown) capable of reading a PBI 22 and writing to (or generating) a PBI 22. The PBI 22 will typically contain one or more data records indicating the number of (or collection of) award credits earned by the player. For vouchers, the gaming device 12 will include a voucher reader and a voucher printer in operable communication with the game device 12. When the player selects to terminate play, the gaming device 12 prints a voucher indicating the number of award credits earned by the player.

The gaming device 12 is also configured to determine the accumulated award credits previously earned by the player, generally by reading the PBI 22 as presented by the player and identifying the award credits. The previous award credits may have been earned from the same gaming device 12 or a similar gaming device having the features of gaming device 12. Promotional award credits may also be issued according to non-gaming activities (such as a promotional mailer) and is generally indicated as PBI distribution 20 in FIG. 1.

The award credits previously earned as identified by the gaming device 12 are accumulated with further award credits which the player may earn during current play of the gaming device 12. Again, the accumulated award credits may be maintained by the player at the termination of play of the gaming device 12 via another PBI 22 which indicates the accumulated award credits thus earned. The PBI 22 thus preserves the "game state" of the player upon termination of play on the gaming device. The player may later resume play of the gaming device 12 at the preserved game state by later presenting the PBI 22, as described above. In the example "BONUS" game of FIG. 2*b*, the player retains the player's earned letters (investment) so that when the player later continues play either on the same or different game, the player's letters (investment) is retained and restored and the player resumes play from the preserved game state. Although described herein for the purposes of redeeming tangible prizes and service, it will be readily apparent to those skilled in the art that the present invention is suitable for use with preserving game states (e.g., award credits, game pieces) for use with bonus games, progressive games, investment bonus games, among others.

Referring again to FIG. 1, the prize station 14 comprises one or more prizes 18. The prizes may be tangible goods (e.g., diamonds, keys to a car, event tickets), services, or monetary awards. Although not required for operation of the invention, the prizes are not generally redeemable directly via cash payments by the player to the prize station or the game devices. Rather the prizes are normally redeemable via award credits earned by the player from playing the gaming device 12 or from other distribution means 20. The redemption process 26 is initiated by a player, generally by presenting one or more PBI 22 to the prize station 14. The prize station 14 is equipped with a PBI reader/writer device (not shown) for reading the PBI 22 and determining the award credits associated with the player from data provided by the PBI 22. The prize station then determines the prizes to which the player is entitled according to the award credits earned by the player. For example, prizes may be selected according to the number of award credits earned (e.g., using a hierarchical prize level arrangement) or according to the collection of types of award credits earned (e.g., game pieces on a game board or puzzle) or both. Other prize payout arrangements may also be used.

Figure 10:
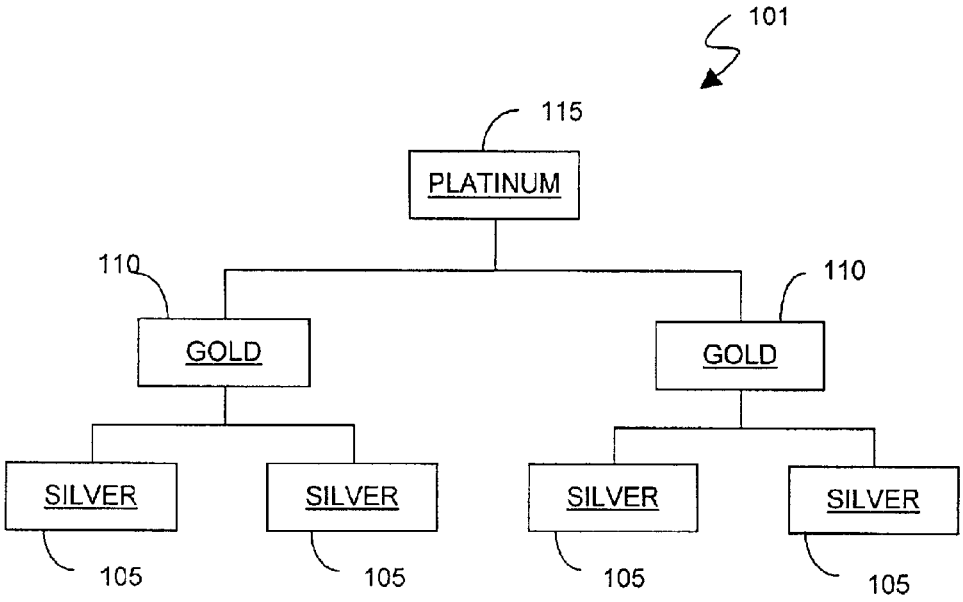
FIG. 10 is a functional block diagram depicting an example hierarchical prize level arrangement suitable for use with the present invention.

FIG. 10 illustrates a sample hierarchical prize level arrangement 101 suitable for use with the present invention. The sample arrangement 101 includes prize levels comprising a silver level 105, a gold level 110, and a platinum level 115. One or more prizes may be associated with each level 105 through 115. For example, bracelet prizes may be available at the silver level 105, watches may be available at the gold level 110, and diamond jewelry may be available at the platinum level. According to this arrangement, the gaming device may provide silver level award 105 during play. The player may decide to redeem the silver award for one of the bracelet prizes, or the player may elect to accumulate additional silver level awards by playing the same or another gaming device. Since arrangement 101 is hierarchical, the player may accumulate two silvers awards to redeem either two silver prizes or one gold prize. Similarly, the player may accumulate 4 silver awards (or two gold awards) to redeem one platinum prize, two gold prizes, 4 silver prizes, or one gold and two silver prizes. As described below, a player retains any unused (unredeemed) credits during prize redemption. That is, suppose a player has accumulated 4 silver awards, the player may decide to redeem a gold award (at the cost of two silver awards), in which case the player retains the two remaining (change) silver awards for later use or accumulation.

The prize station 14 offers the player a selection of prizes. After the player's selection, the selected prize 28 is awarded to the player. According to one embodiment of the invention, the prizes are maintained in vaults having doors secured by latches and windows to thereby allow the player to see the prizes inside the vaults and yet provided a level of security by limiting access to the prize. A button actuator receives the player's selection. In response, the latch is released allowing the player to open the door and retrieve the prize. In another embodiment of the invention, an attendant provides the prize to the player in response to the player's selection. Various security and verification techniques may also be used in conjunction with the invention when the prize is awarded to the player. For example, the invention may implement prize presence and prize inventory verification via ID tags (e.g., optical, RFID tags) affixed or otherwise associated with the prize and transponder sensors at the prize station. In this way the transponder is able to query the ID tag and obtain such information as the presence and identity of the prize including the prize level of the prize, for example. Other security measures may also be implemented including verification of the PBI via a validation server, which verifies transactions indicated by the PBI against records in a database (not shown). Additionally, if an attendant tenders the prize, the attendant may be required to present a code or electronic key identifying the attendant. This identifying information may then be verified against a validation server to determine whether the attendant has sufficient authority to tender prizes to players.

In yet another embodiment of the present invention, the prize station 14 comprises a conventional computer having a display monitor to present the prizes. In this embodiment, a web site may be used to provide an interface to which the player redeems award credits. In yet another embodiment of the invention, prize delivery may be made using a conventional courier services or mail service.

Prizes maintained by the prize station 20 may comprise a hierarchical format having various prize levels, as described above. Where the user selects a prize at a prize level lower than that to which the player is entitled, the player may still have remaining "unused" or change credits. In this case, the prize station 20 may offer the player another prize selection if the player is entitled to yet another prize, or the prize station 20 may issue the player another PBI 22 bearing a data record indicating the award credits still earned, but unused by the player. This PBI 22 may then be presented to the gaming device 12 for accumulation of further award credits based on the continued play of the gaming device 12.

Figure 3:
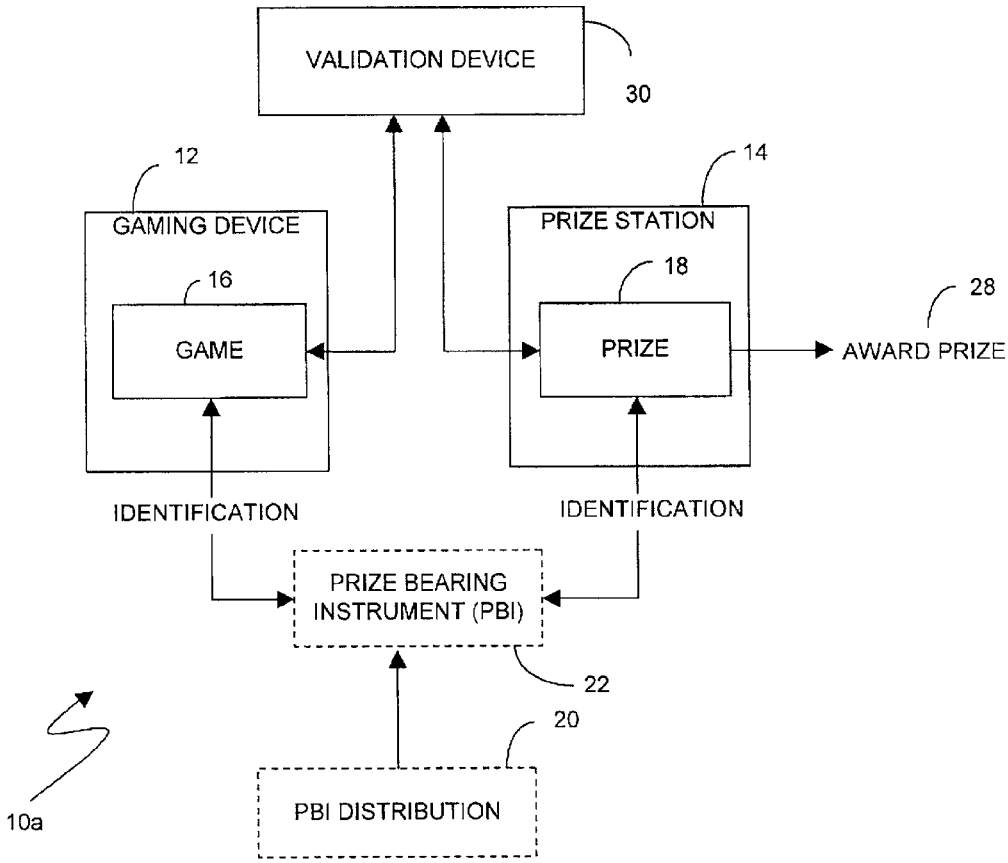
FIG. 3 is a functional block diagram of another example system for maintaining game states utilizing a validation unit in accordance with the present invention.

Referring now to FIG. 3, there is shown another example embodiment of a system 10*a* for maintaining a player's game state in accordance with the present invention. System 10*a*, like system 10 described above in conjunction with FIG. 1, comprises a gaming device 12 for playing a game 16 and a prize station 14 comprising one or more prizes 18. System 10*a* further comprises a validation device 30 which typically comprises a server computer configured with conventional hardware and software components (not shown). The validation device 30 is operatively coupled for communication with the game device 12 and the prize station 14, normally via a network communication.

The validation unit 30 may function in one of a number of ways as described herein. According to one aspect of the invention, the validation unit 30 may serve to validate award credits which are earned and collected by the player on the gaming device 12 and redeemed for prizes at the prize station 16. Various validation means known in the art may be used to carry this out, including maintaining transaction records on the validation unit 30 which corresponds to transaction records identified on the player's PBI 22.

According to another aspect of the invention, the use of the validation unit 30 eliminates (or reduces) the need for recording the actual award credits onto the PBI 22. Rather, the validation unit 30 may serve to maintain the award credits associated with players in a database (not shown) maintained by the validation unit 30. Under this arrangement, the player is identified with a record in the database, which further identifies the award credits earned by the player. The player may use any means for identifying herself the system 10*a*, including using a personal identification number (PIN) or alternatively using a PBI 22, which instead of bearing the award credits earned by the player, provides a unique identifying information to identify the player's corresponding game state (e.g., award credits or game pieces) information.

Figure 4:
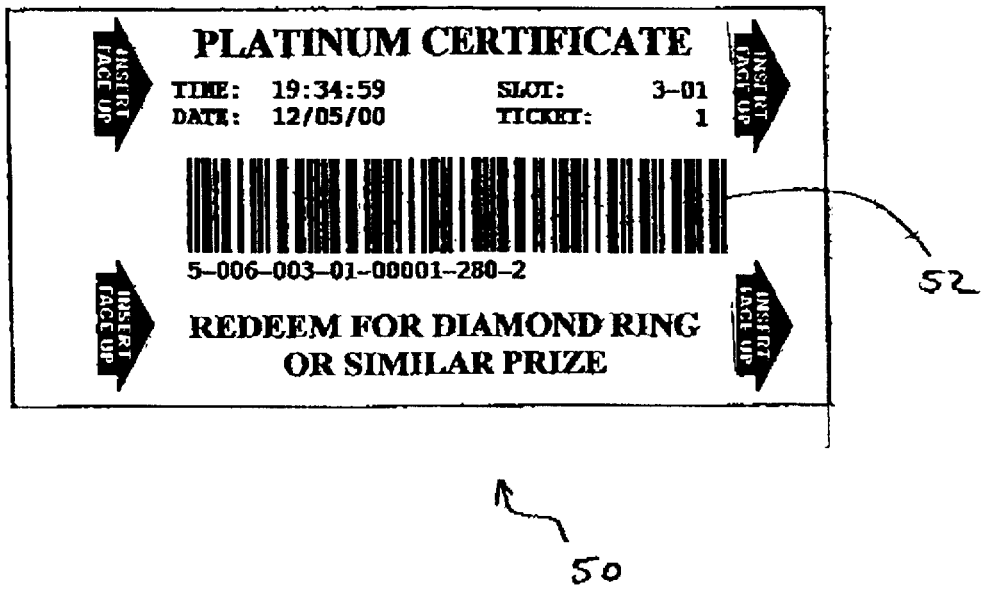
FIG. 4 depicts a sample voucher ticket suitable for use with the present invention.

FIG. 4 depicts an example ticket voucher 50. Ticket voucher 50 which is printed by and read by the gaming device 12 and the prize station 14 includes a data record in the form of a UPC bar code 52. As described above in conjunction with FIG. 3, this data record may identify the player's award credits or may alternatively identify the player's corresponding record in the validation unit's database.

Figure 5:
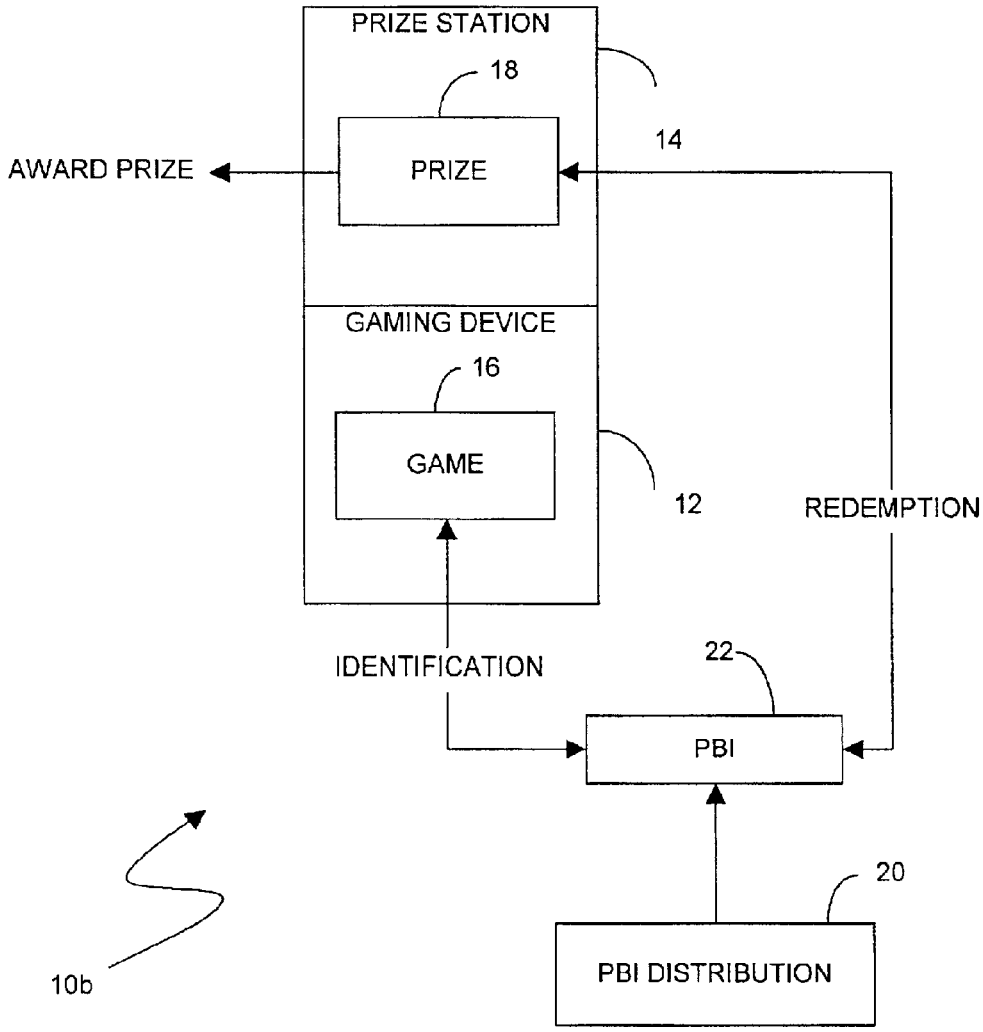
FIG. 5 is a functional block diagram of another example system for maintaining game states in accordance with the present invention where the game device and prize station are integrated in a single unit.

Referring now to FIG. 5, there is shown another example embodiment of a system 10*b* for maintaining a player's game state in accordance with the present invention. System 10*b* like system 10, described above, comprises a gaming device 12 suitable for playing a game 16 and a prize station 14 having one or more prizes 18. In system 10*b*, the gaming device 12 and prize station 14 are integrated into a single unit.

The gaming device 12 and the prize station 14 may further be operatively coupled for communication to allow prize redemption to be made by the player via the gaming device. In this embodiment, the gaming device may include a monitor or other display device (not shown) for displaying game play as well as prize selection on a single display unit. The game unit may further be coupled to or configured to be coupled to a network for connection to the global information network (Internet). Under this arrangement, a web-based scheme may be use to provide prize selection and to select delivery method directly on the gaming device. In this environment, the player's award credits may be used for shopping online. For example, a prize selection may allow a player to purchase a predetermined amount of goods or services from an online merchant (e.g., shopping spree or gift certificate). As depicted in FIG. 5, a PBI 22 may also be used as described above in FIG. 1 and FIG. 3.

Figure 6:
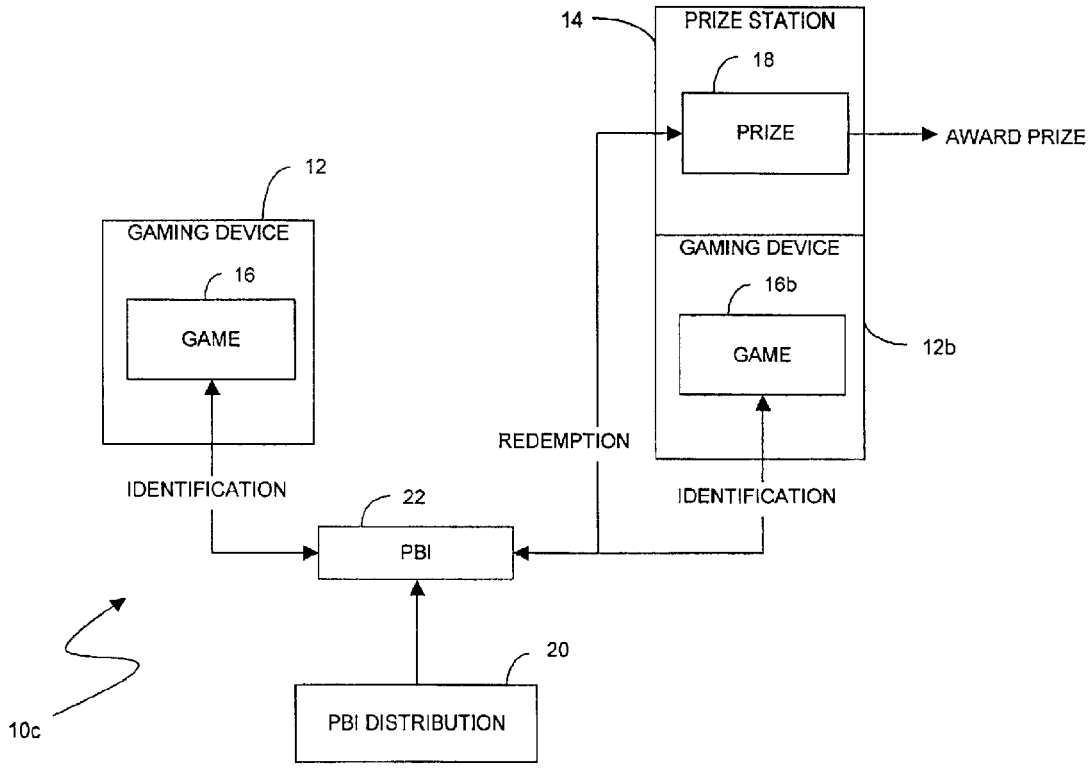
FIG. 6 is a functional block diagram of another example system for maintaining game states in accordance with the present invention.

Referring next to FIG. 6, there is shown another example embodiment of a system 10*c* for maintaining a player's game state in accordance with the present invention. System 10*c* includes a first game device 10 having a game 16 for play and a second game device 10*a* also having a game 16*a* for play. The second game device 10*a* is integrated with a prize station 12 as described above in conjunction with FIG. 5.

The award credits earned by a player on game device 10 may be maintained and later presented and accumulated with additional award credits on game device 10*a* (or game device 10), normally via PBI 22, although as noted above a validation unit may be used to perform this game state maintenance function on the "back-end". Likewise, award credits earned by a player on game device 10*a* may be maintained via the PBI 22 for presentation and accumulation of further award credits on game device 10 (or game device 10*a*). The PBI 22 may also be presented to the prize station 12 for prize redemption as described above.

Figure 7:
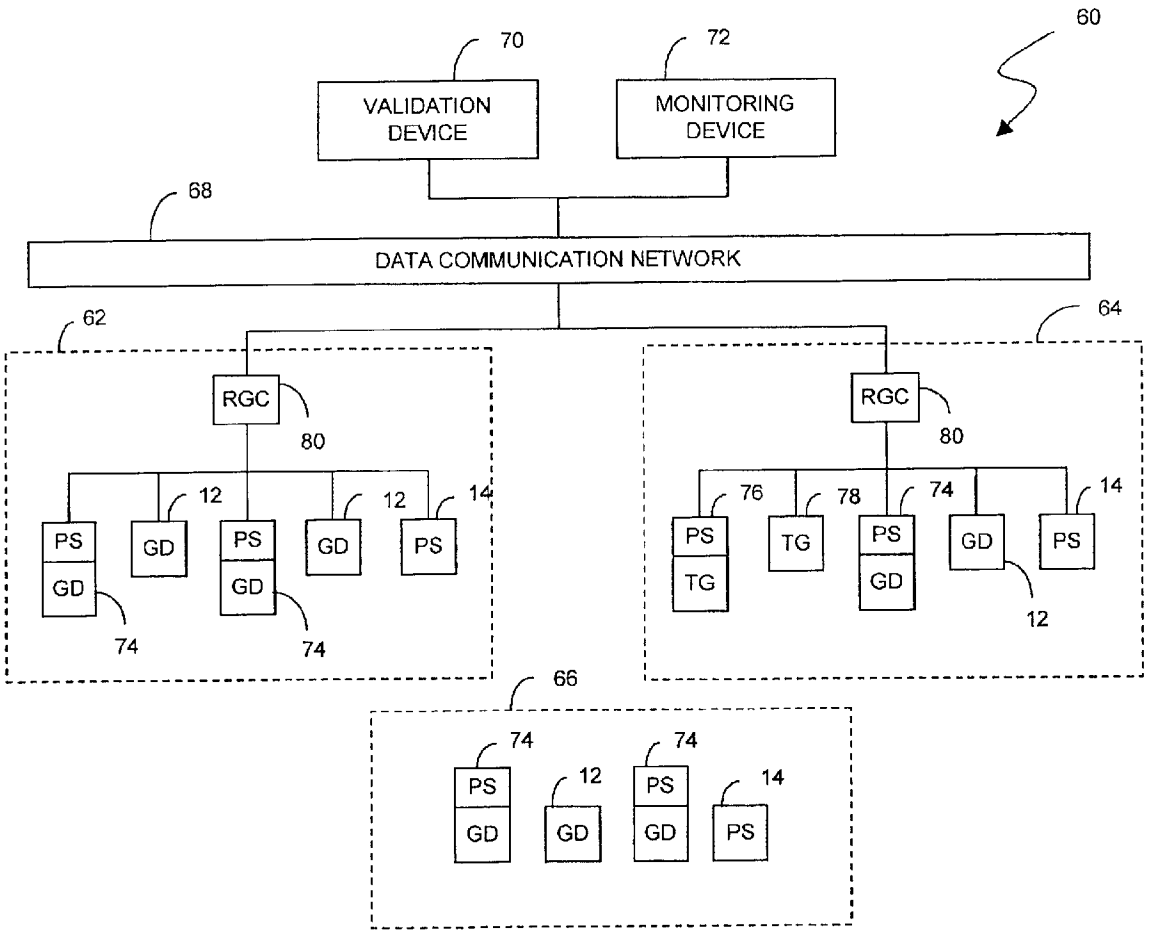
FIG. 7 is a functional block diagram of another example system for maintaining game states having a plurality of sub-systems in accordance with the present invention.

Turning now to FIG. 7, there is shown another example game state maintenance system 60 which comprises a plurality of individual systems 62, 64 and 66. FIG. 7 illustrates that a wide area system may be utilizes with the present invention, which includes both connected and unconnected subsystems. Systems 62 and 64 are each operatively coupled for communication to a validation device 70 and a monitoring device 72 via a data communications network 68.

System 62 comprises a plurality of game devices and prize stations each coupled to a conventional remote game controller (RGC) 80. The RGC 80 is coupled to the communication network 68 for communication with the validation and monitoring units. System 62 includes game devices 12 and a prize station 14 as described above in conjunction with FIG. 1. System 62 further includes integrated game devices and prize stations 74 as described for device 10*a* in conjunction with FIG. 3 above. Award credits earned in any of the gaming devices may be maintained according to the present invention, such as via a PBI 22, via the validation unit 70, or via a combination of the PBI 22 and the validation unit 70 as described above. It would also be within the scope of the present invention, although not required, that award credits earned from system 62 be maintained for use on the other system 64 and 66.

System 64, like system 62 comprises a plurality of game devices and prize stations each coupled to an RGC 80, which is coupled to the communication network 68. The game device of system 64 include table games (TG) 76 and 78 as well as conventional gaming devices 12 and 74 and a prize station 14. Table games 76 and 78 are maintained by an attendant or dealer for the particular table game (e.g., blackjack, roulette). Each table game 76, 78 is also equipped with a PBI reader/writer (not shown) to enable a player of the table game to present her PBI 22 and establish the player's existing or previously earned award credits. Certain game results (such as consecutive blackjacks) may result in further award credits to be earned by the player during play of the table game. At the completion of play the PBI reader/writer may be activated to write to (or generate) a PBI 22 after play is completed by the player. As noted above, the award credits may alternatively be managed by the validation unit 70 in conjunction with the PBI 22, or otherwise without the need for a PBI 22, where for example, player has a PIN number to identify the player. Table game 76 differs from table game 78 in that table game 76 further has in combination a prize station 14, where a player may redeem award credits for prizes.

System 66 also comprises a plurality of game devices and prize stations, but unlike system 62 and 64 is not coupled to the communication network 68. Each game device is thus suitable for operation without the validation unit 70 and monitoring unit 72. Therefore, the management of award credits is generally carried out via PBI 22 as described above.

The validation device 70 operates in substantially the same manner as validation device 30 as described above in conjunction with FIG. 3. Monitoring device 72 provides additional functionality to the system 60 by providing the monitoring of prizes within prize stations and game device/price station units connected therewith (system 62 and 64). Monitoring is carried out using identification tags associated with each prize. For example, radio frequency identification (RFID) tags may be connected or otherwise to associated with each prize. When a prize is selected, a signal is transmitted to the validation device 70 to indicate the prize has been selected. The validation device 70 may further provide inventory and statistical data relating to the game usage and prize redemption.

Figure 8:
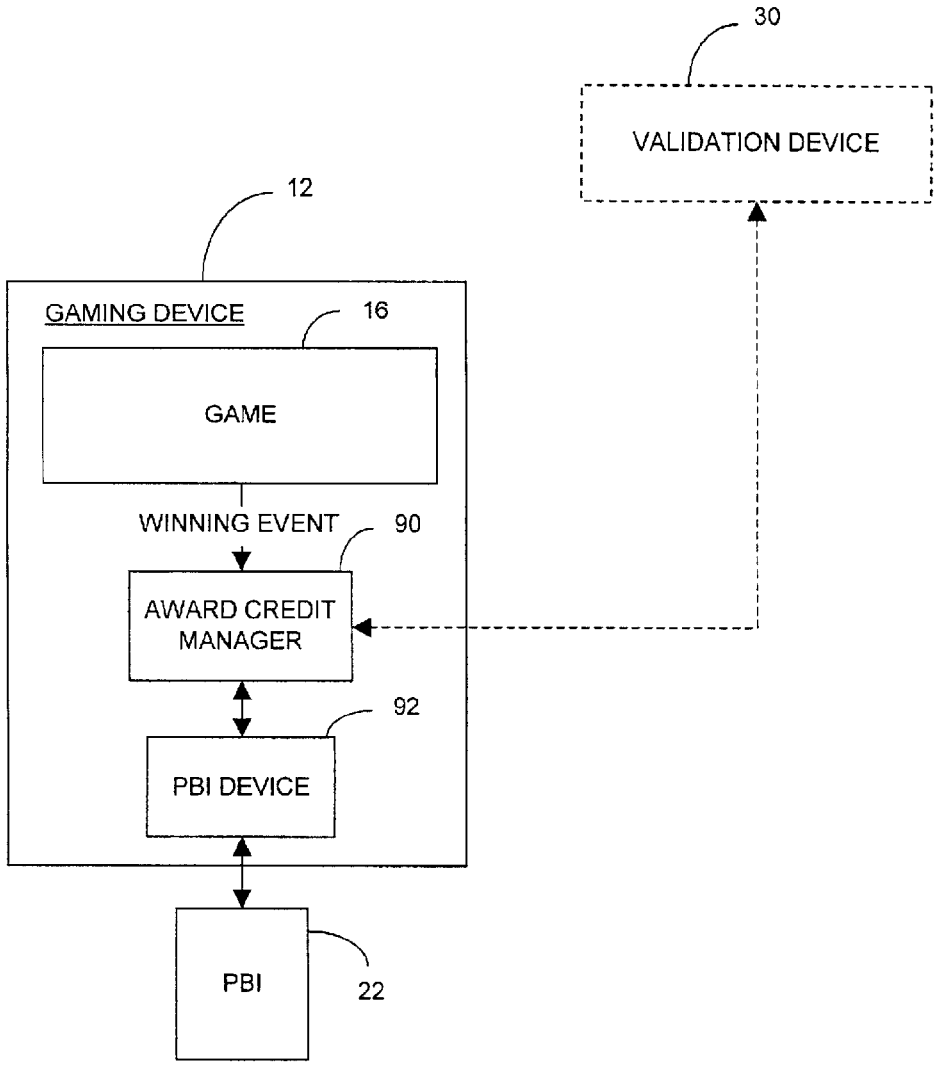
FIG. 8 is functional block diagram showing an example gaming device suitable for use with the present invention.
Figure 9:
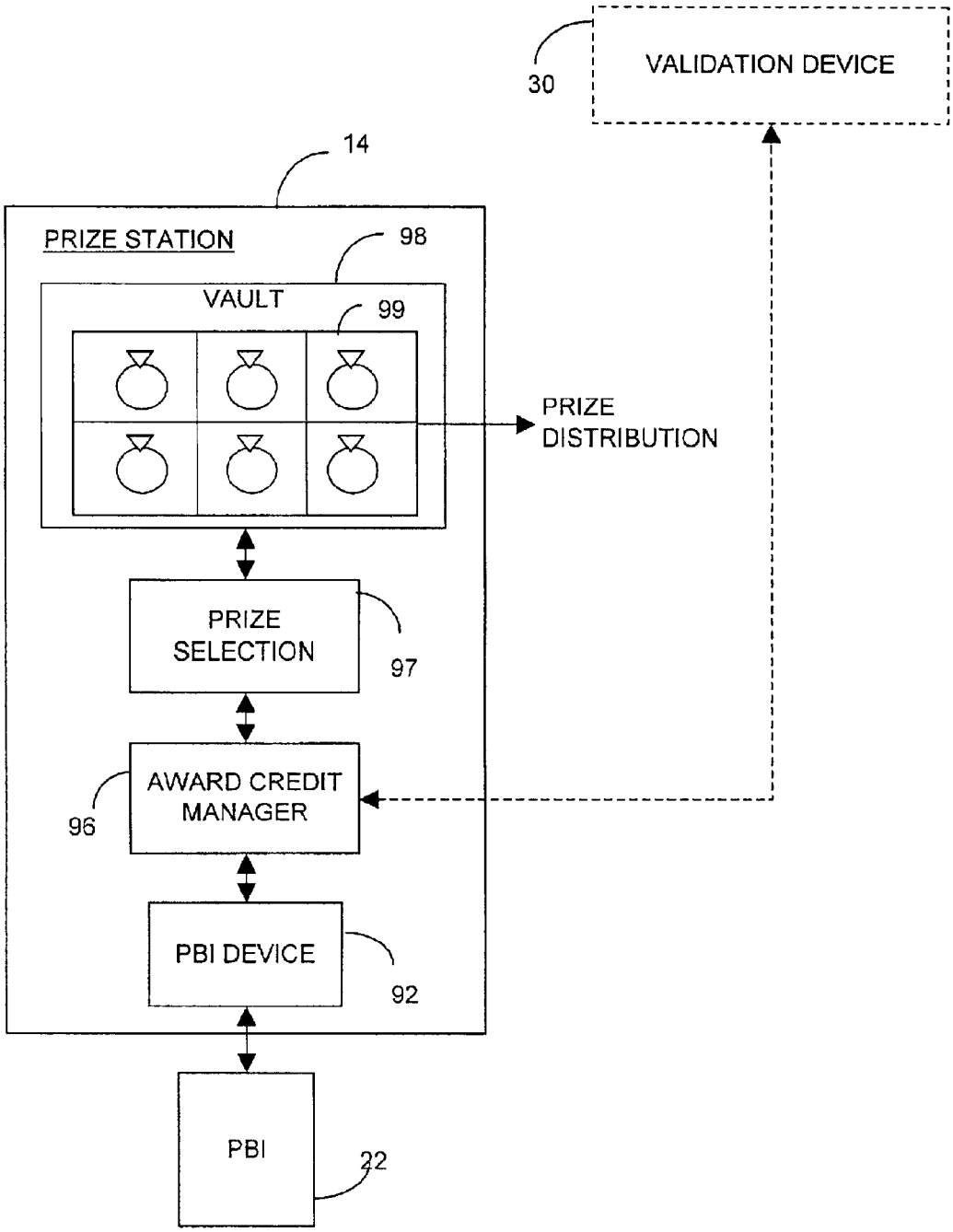
FIG. 9 is functional block diagram showing an example prize station suitable for use with the present invention.

Referring now to FIG. 8 and FIG. 9, the gaming device 12 and the prize station 14 are shown in additional detail. Gaming device 20 comprises a game 16 operatively coupled with an award credit manager 90 operatively coupled for communication with a PBI device 92. The PBI device 92 is configured to read and or write (or generate) PBI 22 as described above. For example, if the PBI 22 comprises a printer ticket (voucher), the PBI device 92 comprises a voucher reader for reading vouchers and indicia printed thereon, such as "Interleaved 2 of 5" bar codes. The PBI device 92 would further include a voucher printer for generating vouchers when the player terminates play on the gaming device 10.

The award credit manager 90 carries out the operation of managing a player's award credits during play. If a player presents a PBI 22 prior to playing, the previously earned award credits are identified either directly from the PBI 22 and/or from the validation device 30 which communicates with the gaming device 10. During play of the game 16, the player may earn additional award credits based on winning game events. Such award credits are accumulated by the award credit manager 90 in conjunction with the previously earned award credits, if any. Upon termination of play of the gaming device by the player, another PBI 22 may be issued to the player which contains data associating the cumulative award credits earned by the player.

Prize station 14 (FIG. 9) comprises a PBI device 92 operatively coupled to an award credit manager 96, a prize selection module 97 coupled to the award credit manager 96, and a plurality of prizes 99 maintained in a vault 98, the vault operatively coupled for communication with the prize selection module 97.

When a player presents one or more PBI 22 devices to the prize station 14, the PBI device 92 determines the award credits associated with the player, either directly from the PBI 22 and/or from the validation unit 30. The award credit manager 96, like award credit manager 90, manages a player's award credits but with respect to prize redemption. The prize selection unit 97 offers to the player one or more prize selections based on the player's award credits. The player may select a prize selection or may cancel prize redemption. If a player selects a prize, the prize is awarded from the vault 98. If the prize selection does not exhaust the player's total award credits, another prize selection may be offered to the player, if the remaining credits are sufficient to support a prize selection from the vault 98. If the remaining award credits are not sufficient to support a prize selection, the remaining award credits are maintained and associated with the player, normally by dispensing another PBI 22 to that effect.

Where an attendant manages a prize booth to carry out the functions of the prize station in accordance with the present invention, the player presents one or more PBI 22 devices to a PBI device 92 associated with the prize booth to ascertain the award credits associated with the player. The player's award credits are indicated to the attendant, normally via a conventional video display device (not shown). The attendant then notifies the player of the prizes (and/or prize levels) to which the player is entitled according to the player's earned award credits. This can be carried out manually via a catalog (or a prize display booth) or automatically via the display device. In response, the player makes a prize selection, and the attendant either manually tenders the prize to the player or provides automatic (via vending device) or courier delivery (e.g., mail, parcel service) to the player.

The present invention's system and method for maintaining a player's game state may further be used to implement a "game within a game". As noted above, the prizes are generally awarded based on award credits earned by a player as a result of playing one or more game devices. According to the present invention, the "game within a game" theory requires the player to earn award credits from a predetermined subset of gaming machines. In this way, the player is encouraged to play those gaming machines that provide the requisite award credits. The player plays the underlying gaming machine, yet the player also plays a "higher level game", namely the collection of award credits (or game pieces) from the predetermined subset of gaming devices, to wit a "game within a game". This "game within a game" essentially revolutionizes traditional investment bonus games on single machines, wherein the investment is made and accumulated based on play of the predetermined subset gaming machines rather than a single machine.

Figure 11:
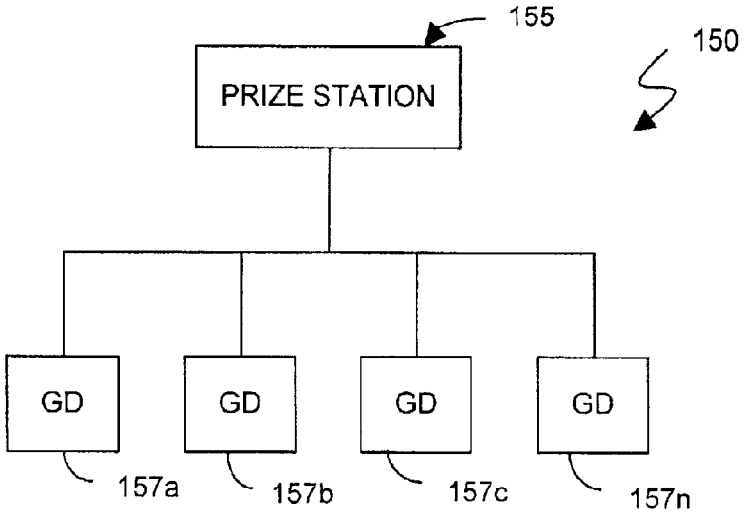
FIG. 11 is functional block diagram depicting one example of a "game within a game" system using the game state maintenance system of the present invention.
Figure 12:
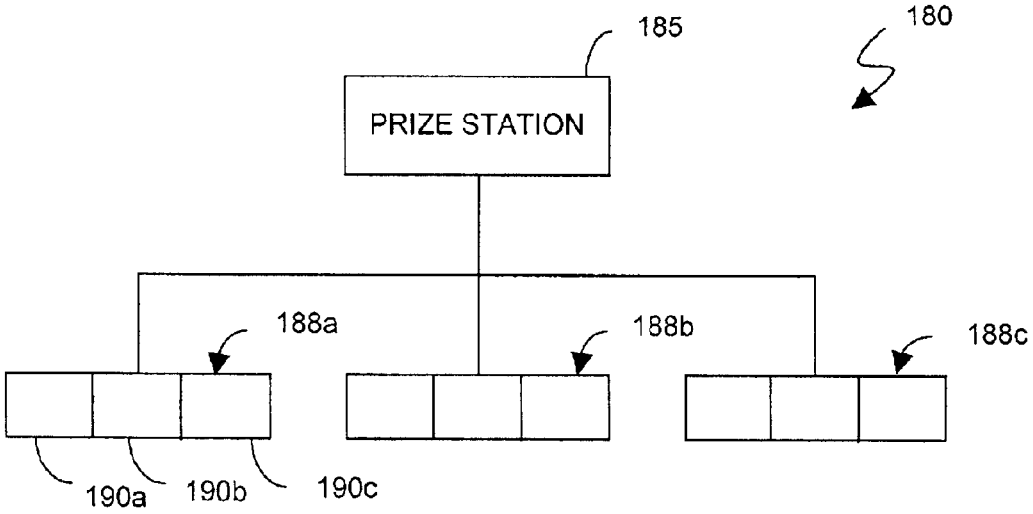
FIG. 12 is functional block diagram depicting a second example of a "game within a game" system using the game state maintenance system of the present invention.

FIG. 11 and FIG. 12 illustrate two example "game within a game" systems which may be implemented using the game state maintenance system of the present invention. The system 150 of FIG. 11 includes a prize station 155 and a plurality of gaming devices 157*a* through 157*n*. Under this arrangement a particular prize awarded by the prize station 155 may require an award credit from each of the gaming devices 157*a* through 157*n*, or perhaps a predetermined subset, such as three award credits, one from any three gaming devices 157*a* through 157*n*. Various other award requirements may also be used. For example, each device 157*a* through 158*n* may of different device types (i.e., slot machine, video poker machine, keno machine, bingo machine, roulette table, blackjack table). In this case, the game system 150 may require an award credit from a predetermine subset of game types.

The system 180 of FIG. 12 includes a prize station 185 and plurality of banks of gaming devices, generally designated 188*a* through 188*c*. Each bank may comprise a plurality of gaming devices 190*a* through 190*c*. Under the "game within a game" arrangement, the system 180 may require an award credit from each "bank" in order to receive a particular prize from the prize station 185. Each bank may be configured as the same game (e.g., blackjack), the same device type (e.g., slot machine), the same family of game (e.g., games manufactured by Sierra Design Group™), or other arrangement, such as within the same casino room, floor, or property.

Accordingly, it will be seen that this invention provides a system and method for maintaining player's game state (award credits or game pieces) in a gaming environment. In particular, the player may restore the game state from previously played games either from the same game device or from another game device. The invention also provides for award redemption of the award credits (or game pieces) earned by a player during game play. Although the description above contains much specificity, the description should not be construed as limiting the scope of the invention but as merely providing an illustration of the presently preferred embodiment of the invention. Thus the scope of this invention should be determined by the appended claims and their legal equivalents.

What is claimed is:

1. A gamming device configured to allow a player to play a game in exchange for a wager in a casino environment, wherein said game comprises a primary game and a secondary game, the gaming device comprising:

a) a ticket printer configured to generate a printed ticket, said printed ticket having indicia thereon to identify a state of said secondary game, b) a ticket reader configured to read said printed ticket and determine said state of said secondary game; and c) a manager module executed on the gaming device configured to restore said state of said secondary game to said determined state after said ticket reader reads said printed ticket, wherein said determined state does not comprise gaming credits suitable for establishing a wager.

2. The gaming device of claim 1, wherein said secondary game requires a collection of earned secondary points to win a bonus prize, said indicia of said ticket further identifying the player's earned secondary points.

3. The gaming device of claim 1, wherein said secondary game requires a collection of earned game pieces to win a bonus prize, said indicia on said ticket further identifying the player's earned game pieces.

4. The gaming device of claim 1, wherein said secondary game requires a collection of earned award points to win a bonus prize, said indicia on said ticket further identifying the player's earned award points.

5. The gaming device of claim 1, wherein said manager module further restores play of said determined state.

6. A method for maintaining the state of a game on a gaming device configured to allow a player to play a game in exchange for a wager operating in a casino environment, said game including a primary game and a secondary game, said method comprising:

a) determining a player's state of the secondary game at the termination of the primary game;

b) generating a printed ticket, said printed ticket having indicia thereon to identify the player' secondary game state;

c) dispensing the printed ticket to the player;

d) receiving the printed ticket from the player;

e) determining the player's secondary game state; and f) restoring the secondary game to the state determined as the player's secondary game state.

7. The method of claim 6, wherein said secondary game requires a collection of earned secondary points to win a bonus prize, said indicia on said ticket further identifies the player's earned secondary points.

8. The method of claim 6, wherein said secondary game requires a collection of earned game pieces to win a bonus prize, said indicia on said ticket further identifies the player's earned game pieces.

9. The method of claim 6, wherein said secondary game requires a collection of earned award points to win a bonus prize, said indicia on said ticket further identifies the player's earned award points.

10. A gaming device operating in a casino environment, wherein said game further comprises a secondary game, comprising:

a) means for allowing a player to play a game in exchange for a wager;

b) means for determining said player's secondary game state;

c) means for maintaining said player's secondary game state; and d) means for restoring said player's secondary game state.

* * * * *

US006923721C1

(12) INTER PARTES REEXAMINATION CERTIFICATE (513th)

United States Patent

Luciano et al.

(10) Number: US 6,923,721 C1

(45) Certificate Issued: Jan. 18, 2013

(54) APPARATUS AND METHOD FOR MAINTAINING GAME STATE

(75) Inventors: Robert A. Luciano, Reno, NV (US); Robert W. Crowder, Jr., Las Vegas, NV (US)

(73) Assignee: Bally Gaming, Inc., Las Vegas, NV (US)

Reexamination Request:
No. 95/001,536, Feb. 4, 2011

Reexamination Certificate for:

| | |
|---|---|
| Patent No.: | **6,923,721** |
| Issued: | **Aug. 2, 2005** |
| Appl. No.: | **09/742,679** |
| Filed: | **Dec. 20, 2000** |

(51) Int. Cl.

| | |
|---|---|
| ***G07F 17/32*** | (2006.01) |
| ***A63F 5/00*** | (2006.01) |

(52) U.S. Cl. ..... 463/24; 463/16; 463/18; 463/20; 463/21; 463/25

(58) Field of Classification Search ..... None
See application file for complete search history.

(56) References Cited

To view the complete listing of prior art documents cited during the proceeding for Reexamination Control Number 95/001,536, please refer to the USPTO's public Patent Application Information Retrieval (PAIR) system under the Display References tab.

*Primary Examiner* — Dennis Bonshock

(57) ABSTRACT

A system and method for maintaining player's game state (award credits or game pieces) in a gaming environment is disclosed. In particular, the player may restore the game state from previously played games either from the same game device or from another game device. The invention also provides for award redemption of the award credits (or game pieces) earned by a player during game play.

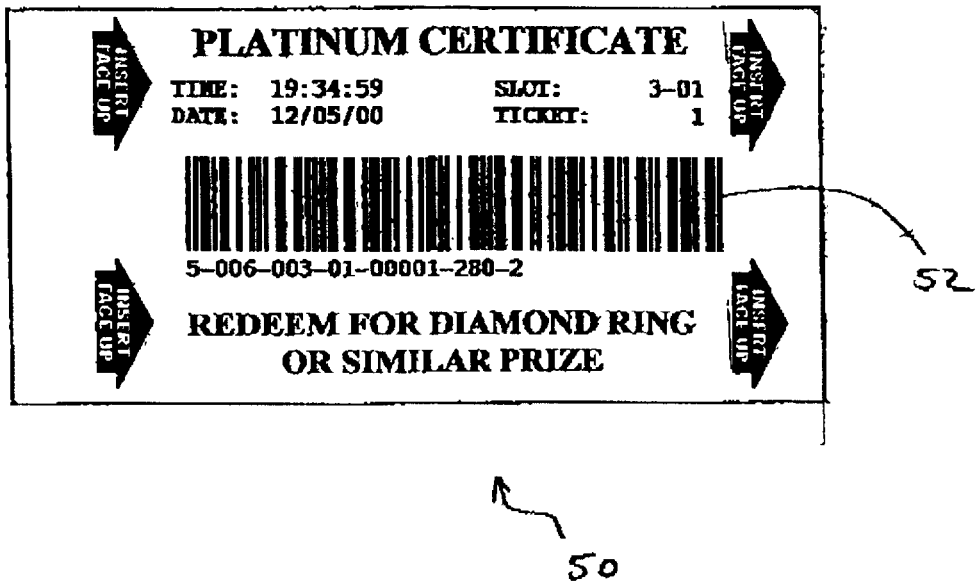

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-25 are cancelled.

* * * * *